US010870036B2

(12) United States Patent
Van Strander

(10) Patent No.: US 10,870,036 B2
(45) Date of Patent: Dec. 22, 2020

(54) SIT-UP BOARD WITH HEEL BLOCK

(71) Applicant: Travis Van Strander, Port Jervis, NY (US)

(72) Inventor: Travis Van Strander, Port Jervis, NY (US)

( * ) Notice: Subject to any disclaimer, the term of this patent is extended or adjusted under 35 U.S.C. 154(b) by 60 days.

(21) Appl. No.: 16/033,878

(22) Filed: Jul. 12, 2018

(65) Prior Publication Data

US 2020/0016455 A1 Jan. 16, 2020

(51) Int. Cl.
*A63B 23/02* (2006.01)
*A63B 21/00* (2006.01)

(52) U.S. Cl.
CPC ..... *A63B 23/0211* (2013.01); *A63B 21/4015* (2015.10); *A63B 21/4037* (2015.10); *A63B 2208/0252* (2013.01); *A63B 2210/50* (2013.01); *A63B 2225/093* (2013.01)

(58) Field of Classification Search
CPC ... A63B 1/00; A63B 21/4015; A63B 21/4037; A63B 23/0211; A63B 2208/0252
See application file for complete search history.

(56) References Cited

U.S. PATENT DOCUMENTS

| | | | | |
|---|---|---|---|---|
| 2,658,754 | A | 11/1953 | Courtney | |
| 3,545,748 | A | 12/1970 | Delinger | |
| 4,182,510 | A | 1/1980 | Lundell | |
| 4,185,816 | A | 1/1980 | Bernstein | |
| 4,212,458 | A | 7/1980 | Bizilia | |
| 4,489,936 | A | 12/1984 | Dal Monte | |
| 4,509,748 | A | 4/1985 | Bezak | |
| 5,417,636 | A | 5/1995 | Havens | |
| 5,722,923 | A * | 3/1998 | Lui | A63B 23/0211 482/140 |
| 6,322,485 | B1 | 11/2001 | Marrero | |
| 7,207,932 | B1 | 4/2007 | Dean | |
| 8,029,426 | B2 | 10/2011 | Sohn | |
| 8,075,463 | B2 * | 12/2011 | Mills | A63B 23/0211 482/140 |
| 9,084,914 | B1 | 7/2015 | Hoffman | |
| 9,242,137 | B1 | 1/2016 | Hoffman | |
| 9,592,416 | B2 | 3/2017 | Thorpe | |
| 2004/0014570 | A1 | 1/2004 | Centopani | |
| 2005/0148449 | A1 | 7/2005 | Weir et al. | |
| 2006/0128539 | A1 | 6/2006 | Marquez | |
| 2007/0066463 | A1 | 3/2007 | Araujo | |
| 2007/0254788 | A1 | 11/2007 | Nam | |
| 2008/0058165 | A1 | 3/2008 | Schletti | |

(Continued)

FOREIGN PATENT DOCUMENTS

| | | |
|---|---|---|
| AU | 2005100971 | 1/2006 |
| AU | 2010101204 | 12/2010 |
| CN | 201643541 | 11/2010 |

OTHER PUBLICATIONS

PCT International Search Report, Application No. PCT/US19/40771, Applicant: Van Strander, Travis, and Written Opinion, dated Sep. 27, 2019, 15 pages.

*Primary Examiner* — Megan Anderson
(74) *Attorney, Agent, or Firm* — Saile Ackerman LLC; Stephen B. Ackerman; Rosemary L.S. Pike

(57) ABSTRACT

A sit-up board is provided comprising a non-slip backboard, a heel block on the backboard, and a foot strap in front of the heel block configured to hold a user's feet together and against both the heel block and the backboard during sit-ups.

14 Claims, 5 Drawing Sheets

(56) References Cited

U.S. PATENT DOCUMENTS

| | | | | |
|---|---|---|---|---|
| 2010/0125027 | A1 | 5/2010 | Abiemo et al. | |
| 2010/0323862 | A1 | 12/2010 | Sohn | |
| 2011/0166005 | A1 | 7/2011 | Cicco | |
| 2012/0316042 | A1 | 12/2012 | Carlson | |
| 2018/0133535 | A1* | 5/2018 | Derry | A63B 21/0442 |
| 2019/0308066 | A1* | 10/2019 | Rusch | A63B 1/00 |

* cited by examiner

SIT-UP BOARD WITH HEEL BLOCK

(1) TECHNICAL FIELD

The disclosure relates to exercise equipment, and more particularly, exercise equipment for sit-ups including means for holding feet in position.

(2) BACKGROUND

Many physical agility tests, especially those given by military or police academies, require sit-ups as one of the tests. Often during a test, someone will firmly hold a person's feet to the ground while the person is performing sit-ups. It would be useful to be able to practice sit-ups with feet firmly held to the ground without relying on another person to do this during each practice session. It may also be beneficial for such academies and/or fitness centers to utilize these devices for training and testing purposes.

Several US Patents disclose exercise equipment that can be used for practicing sit-ups, including U.S. Pat. No. 9,084,914 (Hoffman), U.S. Pat. No. 9,242,137 (Hoffman), and U.S. Pat. No. 9,592,416 (Tharpe), but these references are different from the present disclosure.

SUMMARY

A primary objective of the present disclosure is to provide a device to firmly hold a person's feet in place while performing natural, unassisted sit-ups.

Another objective is to provide a device to firmly hold a person's feet in place while performing natural, unassisted sit-ups with only a solid/smooth surface required, indoors or outdoors.

In accordance with the objectives of the present disclosure, a sit-up board is provided comprising a non-slip backboard, a heel block on the backboard, and a foot strap in front of the heel block configured to hold a user's feet together and against both the heel block and the backboard during sit-ups.

Also in accordance with the objectives of the present disclosure, a method for performing sit-ups is achieved. A sit-up board is provided comprising a non-slip backboard, a heel block on the backboard, and a foot strap in front of the heel block. A user places his or her feet together and against both the heel block and the backboard and tightens the foot strap around and over both feet. The user performs sit-ups wherein the feet are held firmly in place during the sit-ups.

Also in accordance with the objectives of the present disclosure, a sit-up board is provided comprising a non-slip backboard, a cushioning pad on the backboard configured to cushion a user's back and/or buttocks, a heel block on the backboard, a foot strap in front of the heel block configured to hold a user's feet together and against both the heel block and the backboard during sit-ups, a first set of legs on a bottom surface at a top end of the backboard configured to unfold to hold the backboard in an inclined position, and a second set of legs on the bottom surface at a bottom end of the backboard configured to unfold to hold the backboard in a declined position.

BRIEF DESCRIPTION OF THE DRAWINGS

In the accompanying drawings forming a material part of this description, there is shown.

DETAILED DESCRIPTION

It is very difficult to perform a proper sit-up without having one's feet held in place. Physical fitness tests, especially in the military and at police academies, for example, require that one's feet be held in place during sit-ups. This requires the individuals to team up with partners, thus losing efficiency. In preparation for such tests and for one's own fitness goals, it is desirable to practice sit-ups in preparation for such a test while having one's feet held in place. Often, another person is not available to hold one's feet in place in the practice setting. Placing feet under heavy furniture is awkward; the furniture may move or feet could slide out from under the furniture. It is desirable to have a device that would allow a person to perform the required sit-ups alone or without the need for switching between foot holder and sit-up performer, thus saving time and guaranteeing a firm grip on the performer's feet.

The device of the present disclosure provides a solution to the problem of holding one's feet in place during sit-ups. The device holds a user's feet in place in two ways. First, the user's heels abut a heel block to keep the feet from sliding back toward one's body. Next, a strap runs from an outside of one foot, over the top of both feet adjacent to the ankles, and to the outside of the second foot, holding the feet together and down on the device. The strap prevents the feet from moving forward away from the body and from moving upwards away from the surface.

Figure 1:
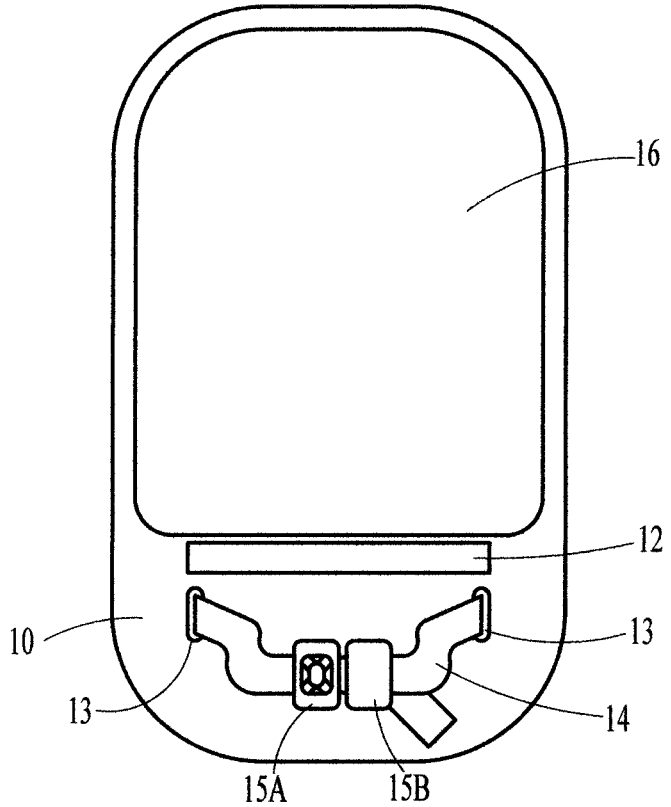
FIG. 1 illustrates a top view of a first preferred embodiment of the present disclosure.
Figure 2:
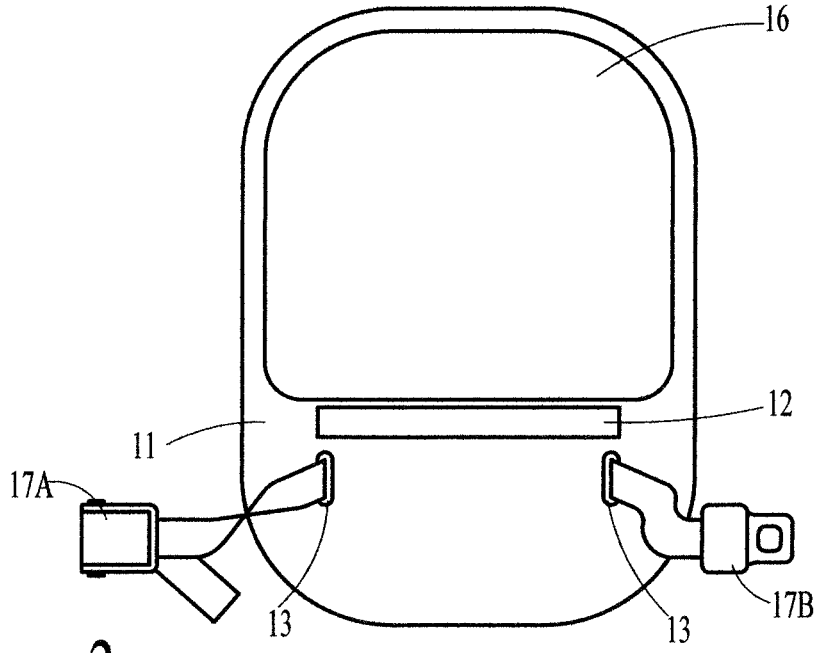
FIG. 2 illustrates a top view of a second preferred embodiment of the present disclosure.

Refer to FIGS. 1 and 2 where two preferred embodiments of the present disclosure are illustrated. In FIG. 1, the device 10 has a length such that an average sized person's shoulder blades will touch the surface of the device when the person is lying prone on the device so that it can be used for official testing. Preferably, the device will have a length of at least four feet in order to achieve this objective. However, in certain situations and for practicing purposes, the device could be shorter so that only a person's feet and buttocks fit on the board. This option 11 is shown in FIG. 2.

The sit-up device is preferably made of a lightweight yet strong composite plastic material with an optional metal core for rigidity. The heel block 12 is preferably molded as part of the backboard 10 or 11. The heel block should have a length of about 8 to 10 inches, a width of about ¼ inch if made from a strong metal to 2 inches if made of a composite or hollow molded material or wood, and a height of 1.5 to 2.5 inches. Attached to the backboard 10 or 11 is a strap 14. Preferably, the strap 14 is treaded down through a first slot 13, underneath the backboard, and up through a second slot 13. FIG. 1 shows the strap 14 in a closed position. FIG. 2 shows the strap an open position. The foot strap 14 must be strong and secure so as to avoid opening during the sit-up repetitions, yet easy enough to get in and out of quickly. Preferably, a cam buckle, such as used for a seatbelt, and a lap belt type strap will be used. It must be easy to strap and unstrap, yet very secure and adjustable for different sized footwear. For example, FIG. 1 shows an automobile-type buckle 15A/15B. FIG. 2 shows an airline-type cam buckle 17A/17B. Any other suitable strap and closure mechanism may be employed.

A thin, durable, cleanable, flat pad 16 is attached on the entire top side of the backboard 10 or 11 to cushion the lower back and buttocks, or just the buttocks, respectively, during the movement. The pad 16 is equivalent to a gym mat or yoga mat in that it does not enhance or hamper a traditional physical agility test sit-up. Preferably the pad 16 is permanently attached to the top surface of the backboard 10 or 11 with adhesives so that it cannot accidentally come loose during use. A hook and loop attachment option may be viable so that the pad can be replaced if the pad wears out or to offer thicker pad options for certain users' comfort.

Figure 5A:
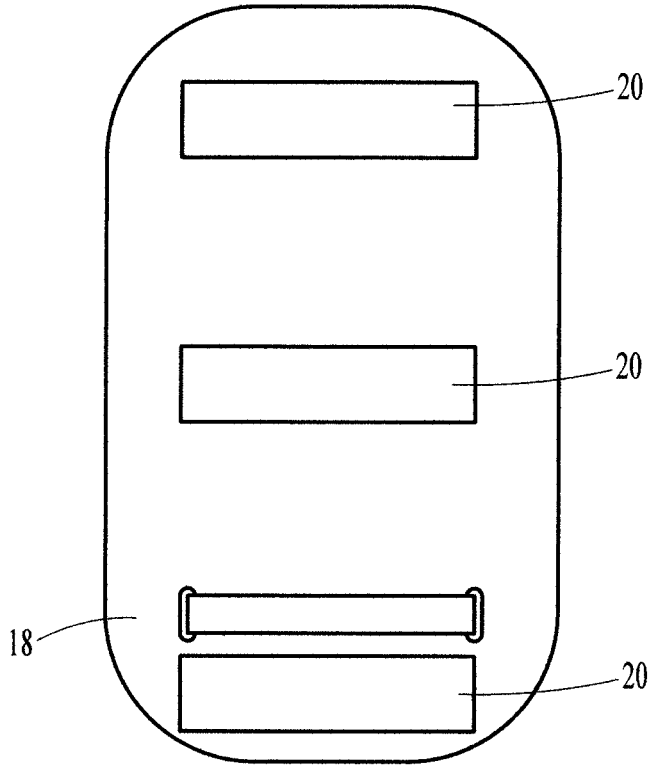
FIG. 5A illustrates a bottom view of a preferred embodiment of the present disclosure.
Figure 5B:
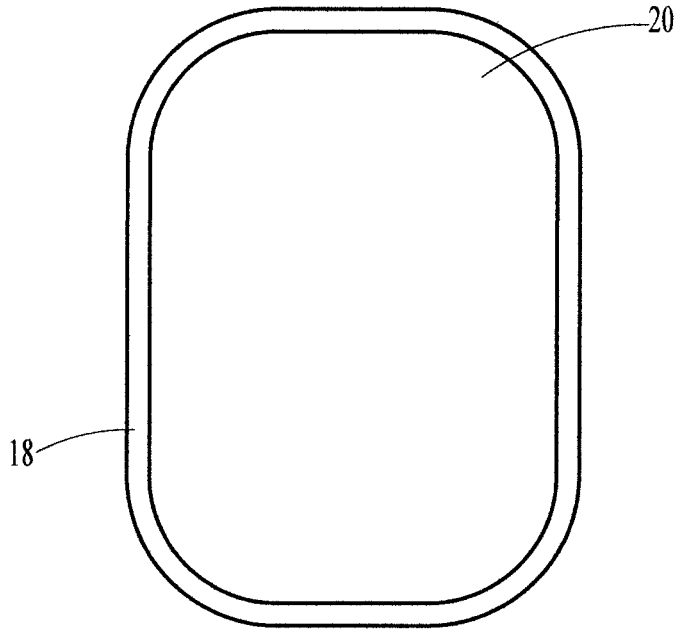
FIG. 5B illustrates an alternative bottom view of a preferred embodiment of the present disclosure.

The bottom surface of the backboard 18, shown in FIGS. 5A and 5B, is fitted with a non-slip rubber material 20 so that the unit will not slide on a slick floor as in a gymnasium during the sit-ups. The rubber material may be placed in strips 20 as shown in FIG. 5A, or in other orientations including coverage of the entire bottom surface, as shown in FIG. 5B, if desired.

The sit-up board of the present disclosure can be stored easily for use in many settings. Police academies, schools, fitness centers, and homeowners would be interested in using this device. It can be slid under a bed, in a closet, behind a couch, etc., in home use when being stored as it will be relatively flat and lightweight. In a school or academy type setting, a specially designed wheeled rack can be used so the units can be stacked together upright or flat and rolled into a storage area.

Figure 3:
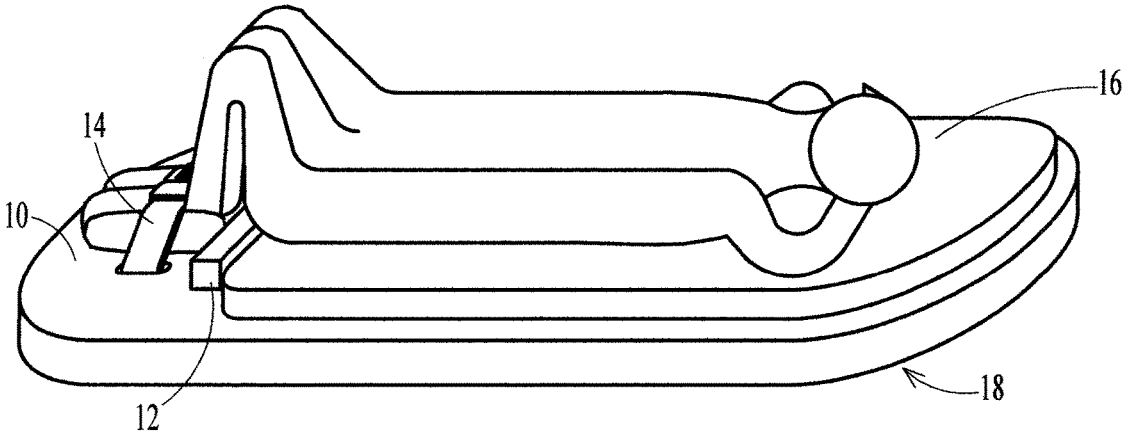
FIG. 3 illustrates a perspective view of the first preferred embodiment of the present disclosure.
Figure 4:
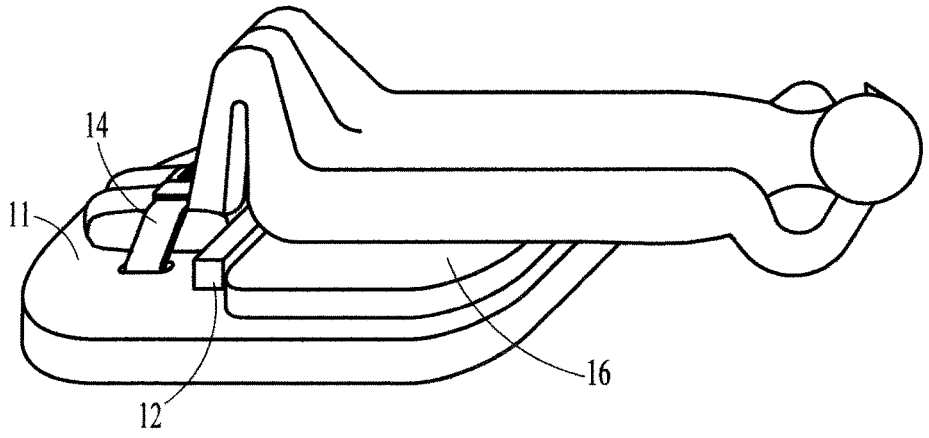
FIG. 4 illustrates a perspective view of the second preferred embodiment of the present disclosure.

FIGS. 3 and 4 illustrate a preferred use of the device of the present disclosure. FIG. 3 illustrates the longer backboard 10 where the user's shoulder blades are supported by the backboard. Strap 14 is shown buckled and tightened over and around the user's feet. The user's heels are abutted to the heel block 12. In FIG. 4, a shorter backboard 11 is provided. Only the user's feet and buttocks are accommodated by the backboard 11. It will be understood that the figures are not drawn to scale.

Figure 6A:
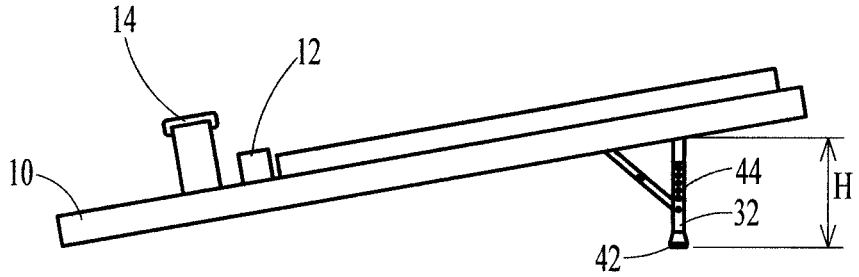
FIG. 6A illustrates a perspective view of a third preferred embodiment of the present disclosure in an inclined position.
Figure 6B:
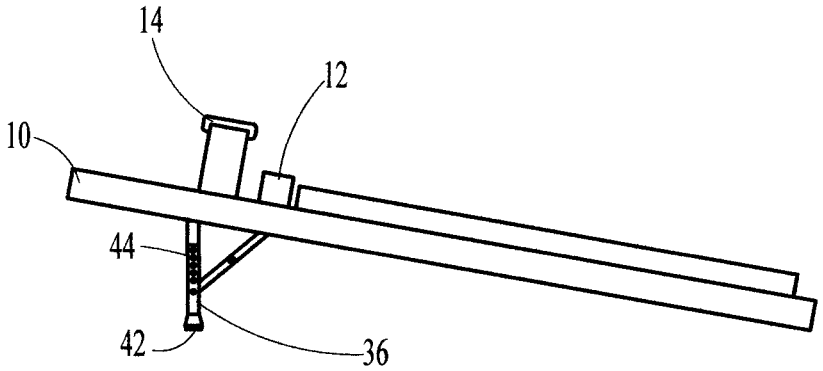
FIG. 6B illustrates a perspective view of the third preferred embodiment of the present disclosure in a declined position.
Figure 6C:
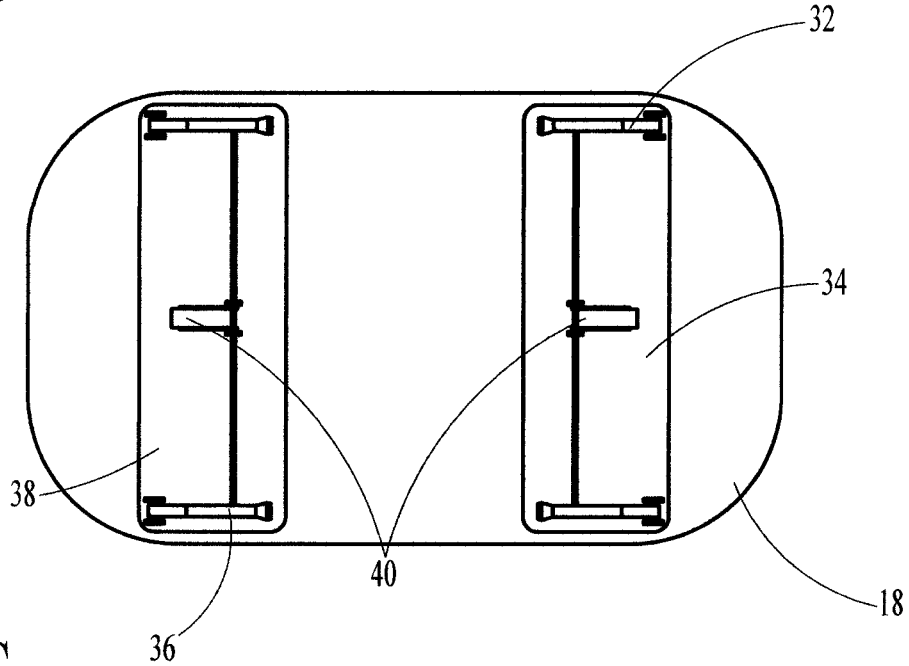
FIG. 6C illustrates a bottom view of the third preferred embodiment of the present disclosure.

FIGS. 6A-6C illustrate a third preferred embodiment of the present disclosure. In a practice setting, it may be desirable to allow a user to achieve a slight incline or decline position. This would be achieved by integrating a short fold down leg system on the top end and bottom end of the backboard. FIG. 6C illustrates the underside 18 of the backboard 10. Legs 32 are shown in a folded position at a top end of the backboard and legs 36 are shown in a folded position at a bottom end of the backboard. Legs 32 and 36 clip into recesses 34 and 38, respectively, in the bottom surface 18 of the backboard.

As shown in FIG. 6A, for an inclined position, the legs 32 at the top end of the backboard 10 are unfolded and locked into place using bar 40, for example. Preferably, the legs have a height H of between about 8 and 14 inches. FIG. 6B shows bottom legs 36 locked in the unfolded position to form a decline. For stability, the legs should be as wide as the board or close to it. Rubber grips 42 on the bottom of the legs will prevent them from sliding on the smooth surface of a floor. The legs could have several height settings using sets of holes 44 with a locking pin that goes through the holes.

Figure 7A:
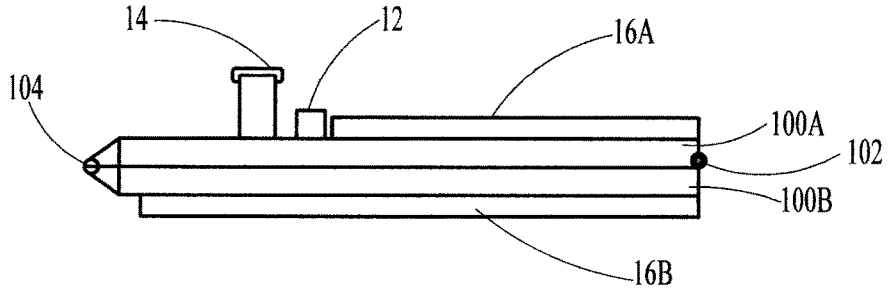
FIG. 7A illustrates a perspective view of a fourth preferred embodiment of the present disclosure in a folded position.
Figure 7B:
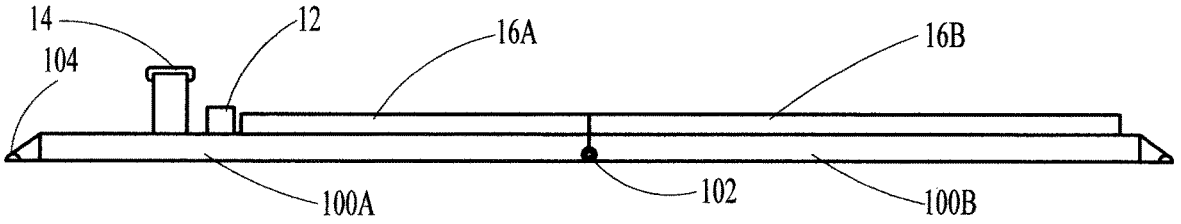
FIG. 7B illustrates a perspective view of the fourth preferred embodiment of the present disclosure in an unfolded position.

In a fourth preferred embodiment of the present disclosure, shown in FIGS. 7A and 7B, a fold up model backboard is shown. The backboard has two sections 100A and 100B. As illustrated in FIG. 7A, hinge 102 allows 100B to fold underneath 100A. The backboard can be used in this position, similarly to the short backboard 11 that accommodates the user's feet and buttocks only. If a longer backboard is desired to support the user's shoulder blades, as in backboard 10, as illustrated in FIG. 7B, the underneath section 100B is unfolded and locked into the open position adjacent to section 100A. Comfort pad section 16A abuts section 16B. For example, a thin metal flat bar could be slid into slots on each side of the hinged area, thus not allowing it to fold or unfold until the bar is removed. This backboard option 100A/100B allows for either a short or a long backboard and may be more easily stored in the folded position.

A handle 104 could be incorporated somewhere on the end for short term transportation. Possibly straps could be fitted onto the backboard so that the user could wear it like a backpack for efficient prolonged transportation.

The sit-up board of the present disclosure is lightweight, compact, and easy to use to hold a person's feet firmly in place while practicing sit-ups or while taking an official sit-up fitness test.

Although the preferred embodiment of the present disclosure has been illustrated, and that form has been described in detail, it will be readily understood by those skilled in the art that various modifications may be made therein without departing from the spirit of the disclosure or from the scope of the appended claims.

What is claimed is:

1. A sit-up board, comprising:

a non-slip backboard;

a rectangular heel block on said non-slip backboard; and a foot strap in front of said rectangular heel block configured to hold a user's feet together and against both said rectangular heel block and said non-slip backboard during sit-ups and further configured to hold said user's heels against a front of said rectangular heel block wherein said rectangular heel block lies between said user's heels and said user's body.

2. The sit-up board according to claim 1 further comprising a cushioning pad on said non-slip backboard configured to cushion the user's back and/or buttocks.

3. The sit-up board according to claim 2 wherein said cushioning pad is permanently attached to said non-slip backboard.

4. The sit-up board according to claim 2 wherein said cushioning pad is removably attached to said non-slip backboard.

5. The sit-up board according to claim 1 wherein a bottom surface of said non-slip backboard is non-slip.

6. The sit-up board according to claim 5 wherein said bottom surface is covered with a rubberized material.

7. The sit-up board according to claim 1 wherein said rectangular heel block has a length of between 8 and 10 inches, a width of between 0.25 and 2 inches, and a height of between 1.5 and 2.5 inches.

8. The sit-up board according to claim 1 wherein said rectangular heel block is molded as part of said backboard.

9. The sit-up board according to claim 1 wherein said foot strap comprises:

a strap threaded down through a first slot in said backboard, across a bottom surface of said non-slip backboard, and up through a second slot in said non-slip backboard;

a buckle attached to a first end of said strap; and a buckle receiver attached to a second end of said strap wherein said buckle is configured to be held firmly in place by said buckle receiver and wherein said strap is configured to be buckled and tightened to hold the user's feet together and in place on said non-slip backboard.

10. The sit-up board according to claim 1 wherein said non-slip backboard:

has a length configured to support the user's feet and buttocks; or has a length configured to support the user's feet, buttocks, and shoulder blades.

11. A method of performing sit-ups comprising:

providing a sit-up board, comprising:

a non-slip backboard;

a rectangular heel block on said non-slip backboard; and a foot strap in front of said rectangular heel block;

placing a user's feet together and against both said rectangular heel block and said non-slip backboard wherein said rectangular heel block lies between said user's heels and said user's body;

tightening said foot strap around and over both said user's feet; and performing sit-ups wherein said user's feet are held firmly together and in place on said non-slip backboard and said user's heels are held against a front of said rectangular heel block during said sit-ups.

12. The method according to claim 11 wherein said sit-up board further comprises a cushioning pad on said non-slip backboard configured to cushion the user's back and/or buttocks.

13. The method according to claim 11 wherein said non-slip backboard comprises a bottom surface having a rubberized material thereon.

14. The method according to claim 11 wherein said foot strap comprises:

a strap threaded down through a first slot in said non-slip backboard, across a bottom surface of said lion-slip backboard, and up through a second slot in said non-slip backboard;

a buckle attached to a first end of said strap; and a buckle receiver attached to a second end of said strap; and wherein said tightening said foot strap comprises:

inserting said buckle into said buckle receiver; and tightening said strap over said user's feet thereby holding said user's feet down against said backboard and back against said heel block.

* * * * *